United States Patent [19]

Snellman et al.

[11] 4,047,713

[45] Sept. 13, 1977

[54] SHEET JOGGER

[75] Inventors: Donald L. Snellman; John C. Kuspert, both of Seattle; Arthur G. Saunders, Maples Valley, all of Wash.

[73] Assignee: Norfin, Inc., Seattle, Wash.

[21] Appl. No.: 648,206

[22] Filed: Jan. 12, 1976

Related U.S. Application Data

[62] Division of Ser. No. 387,541, Aug. 10, 1973, Pat. No. 4,009,071.

[51] Int. Cl.[2] ..... B65H 31/38

[52] U.S. Cl. ..... 271/221; 271/173; 271/224

[58] Field of Search ..... 271/221, 222, 173, 64, 271/224; 270/58

[56] References Cited

U.S. PATENT DOCUMENTS

| | | | |
|---|---|---|---|
| 584,633 | 6/1897 | Gottlieb | 271/221 |
| 3,414,254 | 12/1968 | Snellman et al. | 271/173 |
| 3,598,401 | 8/1971 | Snellman | 271/224 |
| 3,658,324 | 4/1972 | Snellman | 271/222 |
| 3,774,906 | 11/1973 | Fagan et al. | 271/64 |

*Primary Examiner*—Bruce H. Stoner, Jr.
*Attorney, Agent, or Firm*—Dowrey & Cross

[57] ABSTRACT

The jogger includes side edge joggers in combination with an end edge jogger and a resilient sheet stop, both extending the height of a vertical column of sheet receiving compartments. The sheet stop engages and positions the sheets within the sheet receiving compartments in preparation for jogging without damage to the end edges. Thereafter, the side and end joggers align the sheet edges against respectively opposed backstops. The jogger provides simultaneous edge alignment of all four edges of stacked sheets within the sheet receiving compartments and is especially suited for use in conjunction with sheet binding apparatus for simultaneously binding the stacked sheets along corresponding coplanar edges.

4 Claims, 9 Drawing Figures

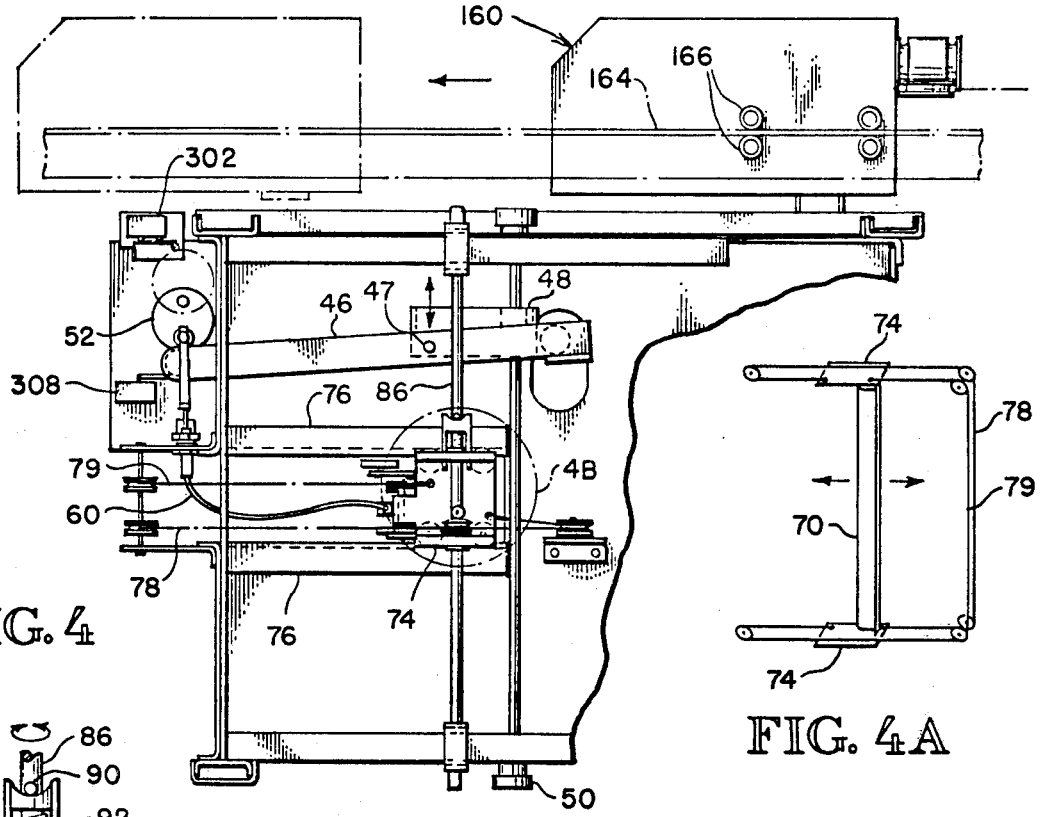
FIG. 4
FIG. 4A
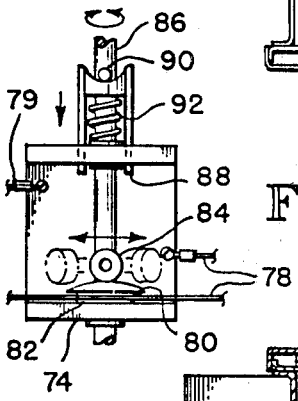
FIG. 4B
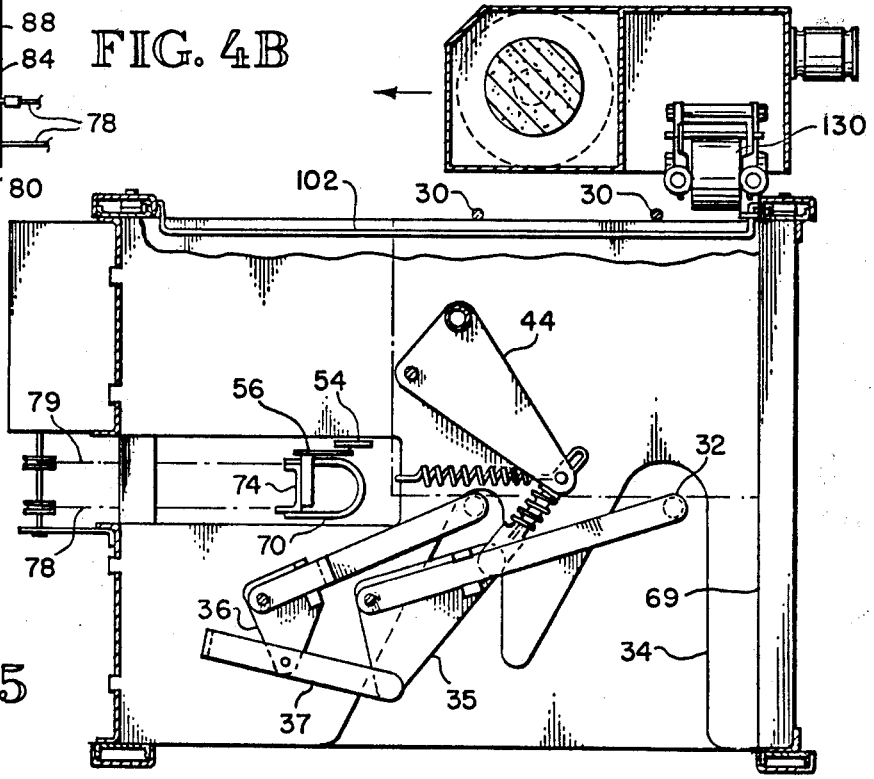
FIG. 5

FIG. 6
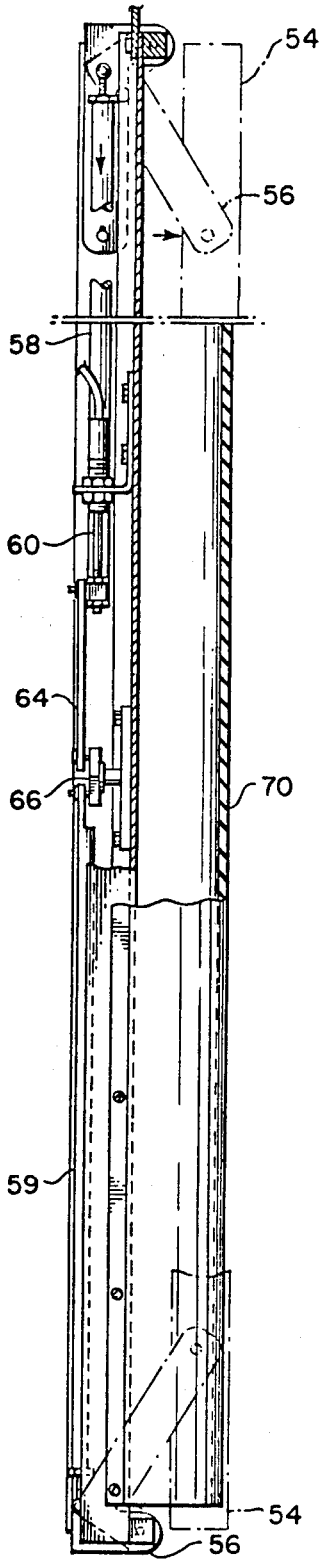
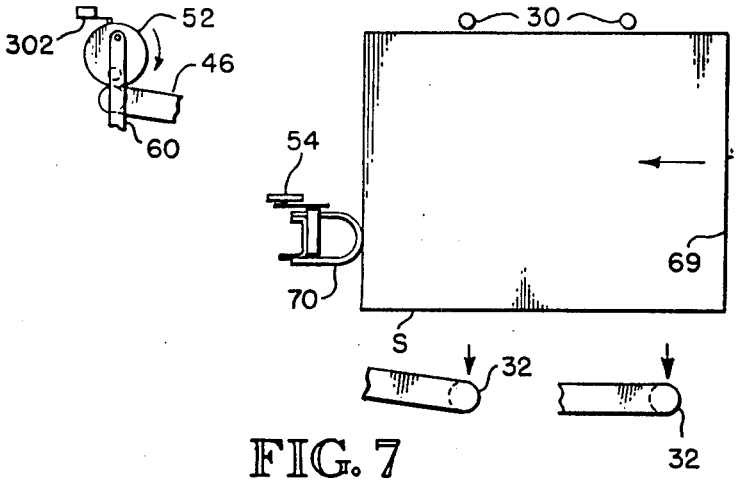
FIG. 7
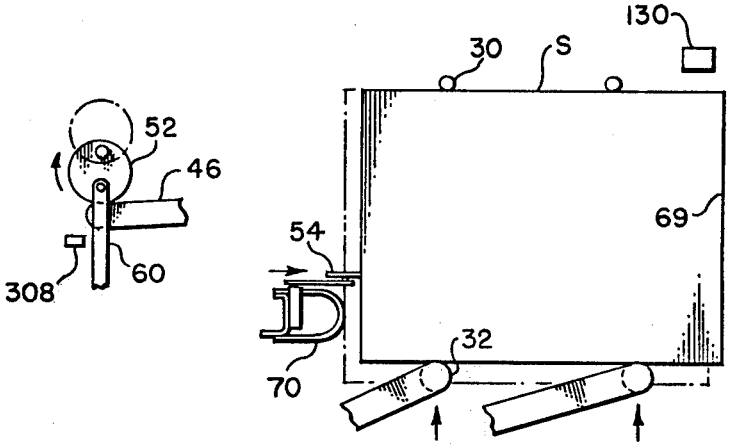
FIG. 8
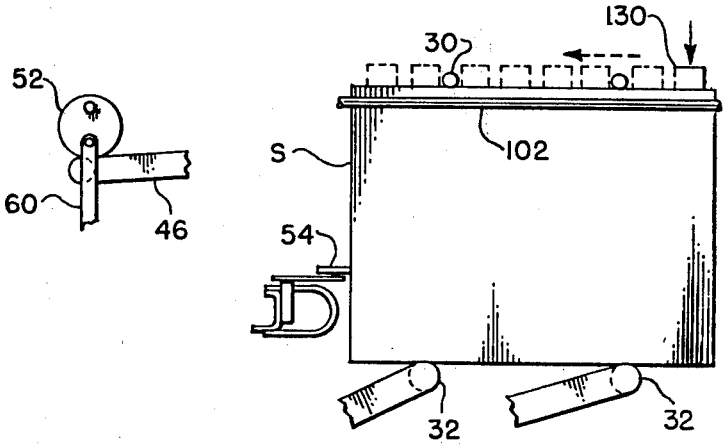
FIG. 9

SHEET JOGGER

BACKGROUND OF THE INVENTION

This is a division of application Ser. No. 387, 541, filed Aug. 10, 1973, now U.S. Pat. No. 4, 009,071.

This invention relates to sheet jogging apparatus.

Sheet joggers for collators, sorters or the like, have heretofor jogged one edge only of the sheets to align the sheets along that edge, with the remaining right angle edges being left generally out of alignment. This has been conventionally accomplished with an active or movable edge jogger for the side edge and merely a passive decelerator or stop for the edge at 90° to the side edge. As a result, the sheets are not adequately aligned during the sorting or collating operation sufficient to bind the sheets into a permanent document.

SUMMARY OF THE INVENTION

This invention provides sheet jogging apparatus for simultaneously aligning all four edges of stacked sheets within a vertical column of sheet receiving compartments. This apparatus is highly suitable for use in conjunction with sheet binding means for simultaneously binding the aligned sheets along corresponding coplanar sheet edges, although the apparatus could be used in other applications in which accurately formed sheet stacks are desirable.

According to one preferred embodiment of the invention, a multiple compartment sheet receiver and side edge jogging means are combined with end edge jogging means, end edge backup means and sheet stop means. The end edge jogging means are movable between a retracted position and an advanced jogging position in which the sheets are aligned against the end edge backup means. The sheet stop means provide a resilient contact surface at an intervening location between the limits of movement of the end edge jogging means. With this construction, therefore, the sheet stop means engage and position the sheets in the sheet receiving compartments in preparation for jogging without damage to the end edges. Thereafter, the end edge jogging means align the end edges against the end edge backup means, while simultaneously therewith the side edge jogging means align one side edges. Thus, it is possible to accurately align both the side and end edges of the stacked sheets in the compartments. Although the preferred side edge jogging means include one or more movable side edge joggers and opposed backup members, it will be recognized that movable side edge joggers could be substituted for the side edge backup members. The terms "side edges" and "end edges" as used herein are not intended to limit the apparatus to use with sheets fed or stacked in a particular orientation.

These and other features, objects and advantages of the present invention will become apparent in the detailed description and claims to follow, taken in conjunction with the accompanying drawings.

BRIEF DESCRIPTION OF THE FIGURES OF THE DRAWING

FIG. 4 is a plan view taken along the line 4—4 of FIG. 3.

FIG. 4A is a schematic illustration of a portion of the jogging mechanism.

FIG. 4B is a fragmentary illustration of another portion.

FIG. 5 is a horizontal section taken along the line 5—5 of FIG. 3.

FIG. 6 is a fragmentary vertical section taken along the line 6—6 of FIG. 2.

FIG. 7 is an operational schematic illustrating the end and side edge joggers prior to jogging the sheet into a desired position.

FIG. 8 is an operational schematic showing the joggers contacting the sheet and moving it into an aligned position.

FIG. 9 is an operational schematic illustrating the joggers in combination with an edge compressing bar when the jogger is used in combination with a binder embodying the principles of the invention.

DETAILED DESCRIPTION OF THE PREFERRED EMBODIMENTS

Figure 1:
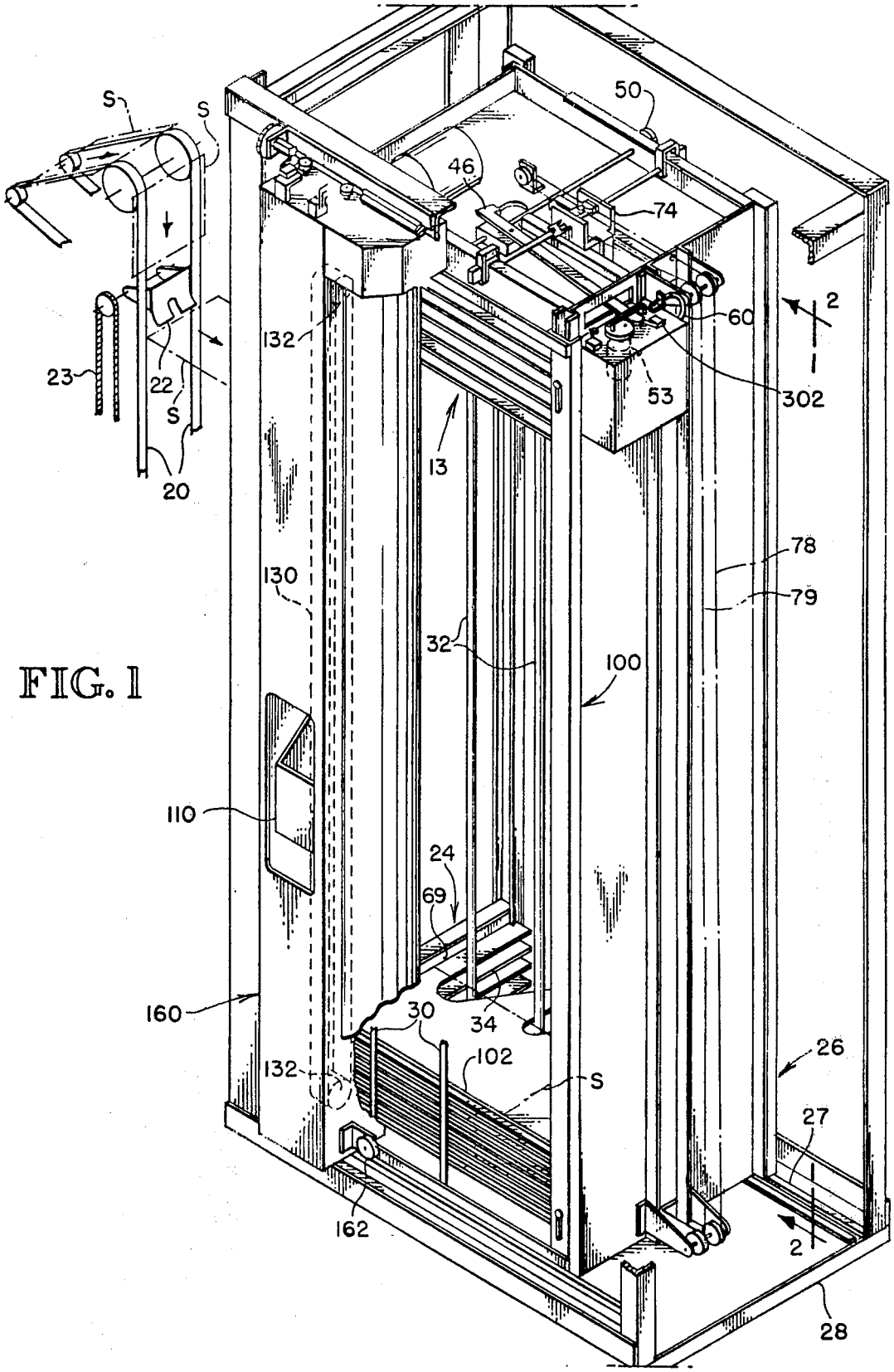
FIG. 1 is an isometric view of a sorter, collator or the like embodying the principles of the invention.
Figure 3:
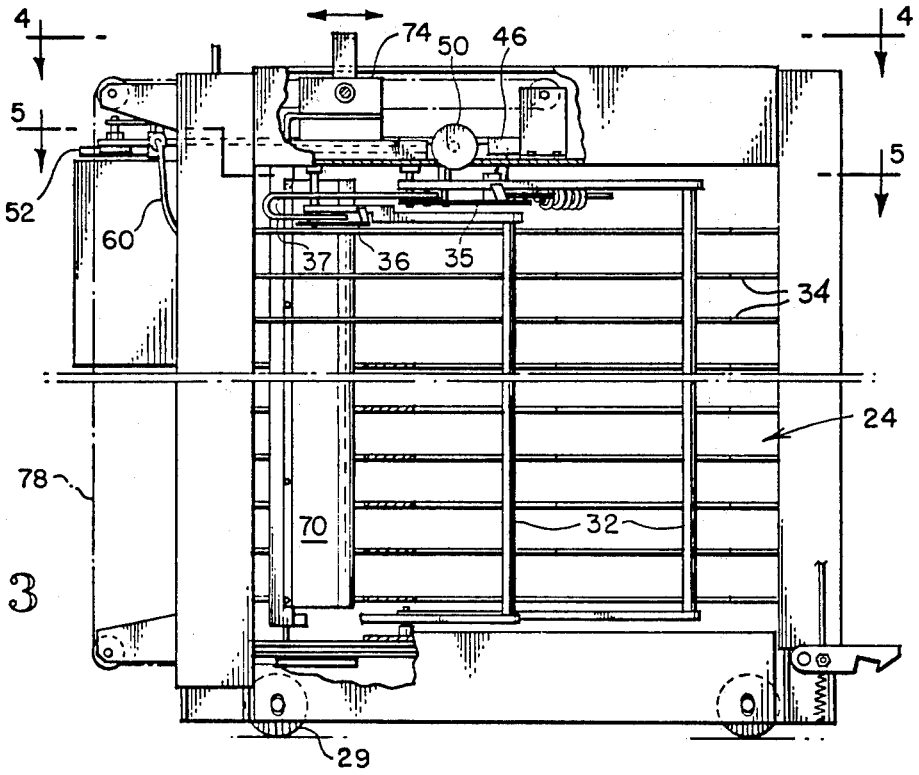
FIG. 3 is a side elevation taken along the direction of the arrows 3—3 of FIG. 2.

In general, the apparatus of this invention is best illustrated in FIG. 1 as used with a sheet sorter. As is well known, the sorter includes a sheet feeding means such as the belts 20 which direct sheets of paper S along a path intersecting with a movable deflector 22. The deflector is positioned vertically by an endless chain 23 and deflects the paper from the belts 20 into a vertical column of sheet bins or compartments 24. As thus far described, a suitable sorter is disclosed in U.S. Pat. No. 3,604,321 which is incorporated herein by reference. The compartments are housed in a movable frame 26 which is supported by rollers 29 (FIG. 3). The rollers ride in a track 27 which is part of a base 28. The rollers permit the movable frame to be moved away from the sheet feeding means for clearing jams. While this type of sheet compartment unit is described, it should be understood that the invention is usable with other well known shorting machines.

In the sorter illustrated in FIG. 1, a binder is mounted adjacent one side of frame 26 for adhesively binding the stacked sheets within compartments 24 along corresponding coplanar sheet edges. The binder includes a housing 160 which is mounted for reciprocative movement by a lower roller 162 which rides in an appropriate channel mounted by the frame, and two upper rollers 166 (FIGS. 2 and 4) which ride along channel 164. The binder further includes a glue belt 130 which is mounted by upper and lower rollers 132 within housing 160 with one run thereof facing the side edges of stacked sheets in compartments 24. A glue pot 110 applies a suitable adhesive to the belt. The belt is movable transversely to and from one or more selected binding positions in contact with the coplanar sheet edges at selected locations along the lengths thereof. Hold-down bars 102 clamp the side edges of the stacked sheets during binding.

JOGGING APPARATUS

Within the movable frame 26 a side edge sheet jogger and an end edge sheet jogger are provided. The terms side edge and end edge will be used throughout this specification for purposes of description, however, it should be understood that sheets may be fed into the compartments with a lengthwise edge forwardmost or a side edge forwardmost and in the latter case for the purpose of definition, the sorter end edge will become the side edge. The side edge jogger is best illustrated in FIG. 1, 3, 5, 7 and 8. The side edge sheet jogger includes a pair of fixed gauge bars 30, positioned along one opened side of the row of compartments and a pair of movable jogging bars 32, movable within slots 34 of the compartments. The movable jogging bars 32 are oscillated by a pair of bell cranks 35 and 36 which are oscillated in unison by link 37.

A main bell crank 44 is oscillated by a lever 46. The lever pivots about a pin 47 on an adjustable bracket 48. The bracket is threaded on an adjustment shaft 50. The remote end of the lever 46 is powered by an electric motor 53 which rotates the cam 52 between the solid line and dotted line position in FIG. 4. Rotation of the cam 52 causes the elongated side edge sheet jogging bars 32 to move in and out in unison to move the sheets over against the fixed guage bars 30.

Figure 2:
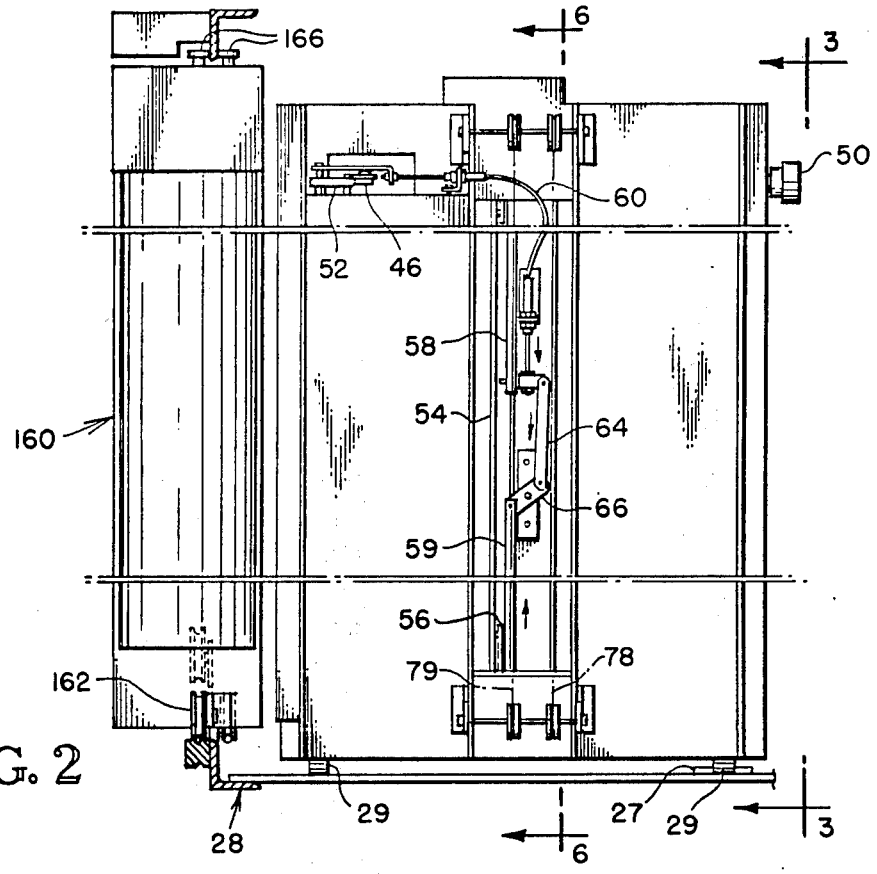
FIG. 2 is a vertical section taken along the line 2—2 of FIG. 1.

Side edge sheet jogging bars have been known heretofor. It is a unique feature of this invention, however, to provide an active end edge sheet jogging bar in conjunction with the active side edge sheet jogging bars to align the right angle edges of the sheets suitable for binding the sheets together. For this purpose, an end edge sheet jogging bar 54 is located at the rear wall of the compartment 24. As best shown in FIGS. 2 and 6, the bar 54 is joined at each end to bell cranks 56. The bell cranks are oscillated by links 58 and 59. Link 58 is reciprocated by a push-pull cable 60 that is coupled to the cam 52. Link 59 is also reciprocated by the cable 60 via a set of links 64 and 66. Consequently, rotation of the cam 52 causes simultaneous oscillation of the side edger bars 32 and the end edge sheet jogger 54.

The end edge jogger moves the sheets forwardly against the forward inside edge 69 of the lower surface of the compartments 24. Also located at the rearward end of the compartments 24 is a passive sheet stop 70. The passive sheet stop is an elongated bar having a substantial thickness of foam rubber or the like at its forward end. The foam rubber absorbs the impact of the sheet as it is moved into the compartment from the deflector 22 and protects the edge from being damaged.

FIGS. 7 and 8 show the operation of the joggers. In FIG. 7 a sheet has just come to rest against the passive end stop 70 and the jogger bars 32 and 54 are separated from the sheet. In FIG. 8, the cam plate 52 has rotated into the solid line position simultaneously moving the side edge joggers 32 and the end edge sheet jogger 54 against a sheet to move the sheet upward and to the right as viewed in FIG. 8. In this position the edges of the sheet abutted against the gauge bars 30 are all in the same vertical plane and the end edges are also in a vertical plane making the groups of sheets suitably arranged for binding.

The end edge sheet jogger bar 54 and sheet stop 70 can be positioned relative to the compartments to provide for differing sheet sizes, as best shown in FIGS. 4A and 4B. As best shown in 4A, the end edge jogger 70 is carried on a frame 74 which slides in a pair of spaced tracks 76. The frame is positioned toward and away from the compartments by a parallelogram cable system 78. The cable system couples the upper end of the frame 74 to the lower end of the frame so that both ends move in direct parallelism with each other to keep the active jogging element 54 in a straight vertical line. The frame 74 is locked in its set position by a brake 80 that is pushed against a brake shoe 82 by a movable roller 84. As best shown in FIG. 4B, the roller can be placed in its center-most position pushing the brake shoe 82 against the brake 80 to lock the frame 74 or can be swung laterally to the phantom line position to release the brake shoes 80 and 82. An operator controlled rod 86 is coupled to the roller 84 and passes through a latching mechanism 88. The latching mechanism includes a concave cam surface and a pin 90 that passes through the rod 86. As can be readily seen, rotation of the rod 86 moves the bracket 38 to the right moving the roller 84 to the phantom line position and releasing the frame 74. When the operator releases the rod 86, a spring 92 urges the pin 90 back to its original position, pulling the roller 84 automatically into its braking position.

As thus far described, it can be seen that a plurality of sheets can be readily stacked in the various compartments and their edges aligned in vertical planes.

In operation, jogger motor 53 is energized when appropriate, in the illustrated example upon commencement of the binding operation. Referring to FIGS. 7-9, motor 53 rotates cam 52 in the direction indicated (FIG. 8) until jogger bars 32, 54 are positioned at their advanced jogging positions tight against respective sheet edges, as shown (FIG. 9). At the FIG. 9 position, switch 308 is operated by lever 46 and causes motor 53 to be deenergized, while the jogger bars remain tight against the sheet edges. To retract the jogger bars, motor 53 is re-energized, in the illustrated example upon completion of the binding operation, and rotates cam 52 in the direction indicated until it resumes its FIG. 7 position. Upon return of jogger bars 32, 52 to their retracted FIG. 7 position, switch 302 is operated by cam 52 and causes motor 53 to be de-energized.

While the preferred embodiments of the invention have been illustrated and described, it should be understood that variations and alternatives will be apparent to one skilled in the art without departing from the principles herein. Accordingly, the invention is not to be limited to the specific embodiments described.

We claim:

1. In combination with a sheet receiver including a vertical column of sheet receiving compartments, jogging means including side jogging means mounted adjacent one side of the receiver and movable with respect to a side jogging position in simultaneous contact with the side edges of stacked sheets in said compartments for establishing coplanar alignment thereof, and side backup means mounted adjacent the opposite side of the receiver and engagable with the opposite side edges of the stacked sheets in said compartments for establishing coplanar edge alignment thereof simultaneously with operation of said side jogging means, the improvement comprising:

end jogging means mounted adjacent one end of the receiver and movable between a retracted position spaced from the end edges of the stacked sheets in said compartments and an advanced jogging position in simultaneous contact with the end edges of the stacked sheets in said compartments for establishing coplanar alignment thereof;

backup means mounted adjacent the opposite end of the receiver and engagable with the opposite end edges of the stacked sheets in said compartments for establishing coplanar alignment thereof simultaneously with operation of said end jogging means; and sheet stop means mounted by the receiver adjacent said end jogging means at a location intervening between said retracted position and said advanced jogging position for engaging the end edges of sheets entering said compartments from the opposite end of the receiver toward the one end thereof, and positioning the sheets upon such entry thereof into said compartments with their end edges spaced from said advanced position a sufficient distance that said end jogging means may thereafter contact the sheet end edges and move the sheets against said backup means into coplanar end edge alignment.

2. The combination of claim 1, wherein said end jogging means include an elongated member having a length corresponding to the height of the receiver column, and means for moving said member to and from said advanced jogging position in simultaneous contact with the end edges of the stacked sheets in said compartments while simultaneously therewith maintaining vertical alignment of said member.

3. The combination of claim 1, wherein said sheet stop means include an elongated cushioning member extending vertically the height of the receiver column.

4. The combination of claim 1, further comprising means for selectively adjusting the location of said end jogging means and said sheet stop means with respect to the ends of the receiver in order to align the end edges of sheets of different lengths.

* * * * *